US006697029B2

(12) United States Patent
Teillet et al.

(10) Patent No.: US 6,697,029 B2
(45) Date of Patent: Feb. 24, 2004

(54) ANTENNA ARRAY HAVING AIR DIELECTRIC STRIPLINE FEED SYSTEM

(75) Inventors: Anthony Teillet, Flower Mound, TX (US); Kevin Le, Arlington, TX (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 10/086,233

(22) Filed: Feb. 28, 2002

(65) Prior Publication Data

US 2002/0135528 A1 Sep. 26, 2002

Related U.S. Application Data

(60) Provisional application No. 60/277,401, filed on Mar. 20, 2001.

(51) Int. Cl.[7] ..... H01Q 21/26

(52) U.S. Cl. ..... 343/797; 343/795; 343/821; 343/853

(58) Field of Search ..... 343/793, 795, 343/797, 850, 853, 906, 821, 893

(56) References Cited

U.S. PATENT DOCUMENTS 5,952,983 A * 9/1999 Dearnley et al. ..... 343/817
5,966,102 A * 10/1999 Runyon ..... 343/820
6,034,649 A * 3/2000 Wilson et al. ..... 343/795
6,072,439 A * 6/2000 Ippolito et al. ..... 343/797

* cited by examiner

*Primary Examiner*—James Clinger
*Assistant Examiner*—Shih Chao Chen
(74) *Attorney, Agent, or Firm*—Jackson Walker LLP; Robert C. Klinger

(57) ABSTRACT

An antenna (10) having a plurality of unitary dipole antennas (12) formed by folding a stamped piece of sheet metal. Each of the unitary dipole antennas (12) are fed by two stripline feed systems (20, 22). Each of these feed systems are separated above and extend over a groundplane (14) and are separated by an air dielectric to minimize intermodulation (IM). Phase shifters (40, 42, 44) in combination with a downtilt control lever (52) are slidably adjusted beneath the respective dividing portions of the stripline feed system to adjust signal phase and achieve a uniform beam tilt having uniform and balanced side lobes. These stripline feed systems can also be formed from stamped sheet metal and which have distal ends bent 90° upward to couple to the respective dipole antennas (12).

20 Claims, 15 Drawing Sheets

ANTENNA ARRAY HAVING AIR DIELECTRIC STRIPLINE FEED SYSTEM

PRIORITY CLAIM

This application claims priority of provisional application number 60/277,401, filed Mar. 30, 2001, entitled "Antenna Array".

CROSS REFERENCE TO RELATED APPLICATIONS

Cross reference is made to commonly assigned U.S. patent application Attorney's Docket No. 100318.00101 entitled "Antenna Array", and U.S. patent application Attorney's Docket No. 100318.00103 entitled "Antenna Array Having Sliding Dielectric Phase Shifters", the teaching of each of these applications being incorporated herein by reference and filed herewith.

FIELD OF THE INVENTION

The present invention is generally related to antennas, and more particularly to mobile communication antennas having dipole antennas, beam forming capabilities including downtilt, and reduced intermodulation (IM).

BACKGROUND OF THE INVENTION

Wireless mobile communication networks continue to be deployed and improved upon given the increased traffic demands on the networks, the expanded coverage areas for service and the new systems being deployed. Cellular type communication systems derive their name in that a plurality of antenna systems, each serving a sector or area commonly referred to as a cell, are implemented to effect coverage for a larger service area. The collective cells make up the total service area for a particular wireless communication network.

Serving each cell is an antenna array and associated switches connecting the cell into the overall communication network. Typically, the antenna array is divided into sectors, where each antenna serves a respective sector. For instance, three antennas of an antenna system may serve three sectors, each having a range of coverage of about 120°. These antennas are typically vertically polarized and have some degree of downtilt such that the radiation pattern of the antenna is directed slightly downwardly towards the mobile handsets used by the customers. This desired downtilt is often a function of terrain and other geographical features. However, the optimum value of downtilt is not always predictable prior to actual installation and testing. Thus, there is always the need for custom setting of each antenna downtilt upon installation of the actual antenna. Typically, high capacity cellular type systems can require re-optimization during a 24 hour period. In addition, customers want antennas with the highest gain for a given size and with very little intermodulation (IM). Thus, the customer can dictate which antenna is best for a given network implementation.

SUMMARY OF THE INVENTION

The present invention achieves technical advantages as an air dielectric stripline feed system stamped from a sheet of metal, with one air dielectric stripline being coupled to each respective dipole radiating elements of each antenna. Each air dielectric stripline feed system is non-physically coupled to a sliding dielectric phase shifter disposed between the stripline and the groundplane and adapted to provide downtilt, while still maintaining uniform side lobes. Preferably, up to 10° of downtilt is obtainable.

The cross-shaped unitary dipole antenna has a unitary dipole radiation element formed by folding a stamped sheet of metal. The unitary dipole radiation element is vertically polarized and has the general shape of a cross. Two radiation elements each have a 90° bend and are commonly connected to each other at a base but are separated above a groundplane by a cross-shaped dielectric spacer. A cross-shaped, non-conductive clip is attached to the top of the antenna to maintain an orthogonal relationship between the four radiating sections of the unitary dipole antenna.

BRIEF DESCRIPTION OF THE DRAWINGS

For a more complete understanding of the present invention, reference is made to the following detailed description taken in conjunction with the accompanying drawings wherein.

DETAILED DESCRIPTION OF THE PREFERRED EMBODIMENT

The numerous innovative teachings of the present application will be described with particular reference to the presently preferred exemplary embodiments. However, it should be understood that this class of embodiments provides only a few examples of the many advantageous uses and innovative teachings herein. In general, statements made in the specification of the present application do not necessarily delimit any of the various claimed inventions. Moreover, some statements may apply to some inventive features, but not to others.

Figure 1:
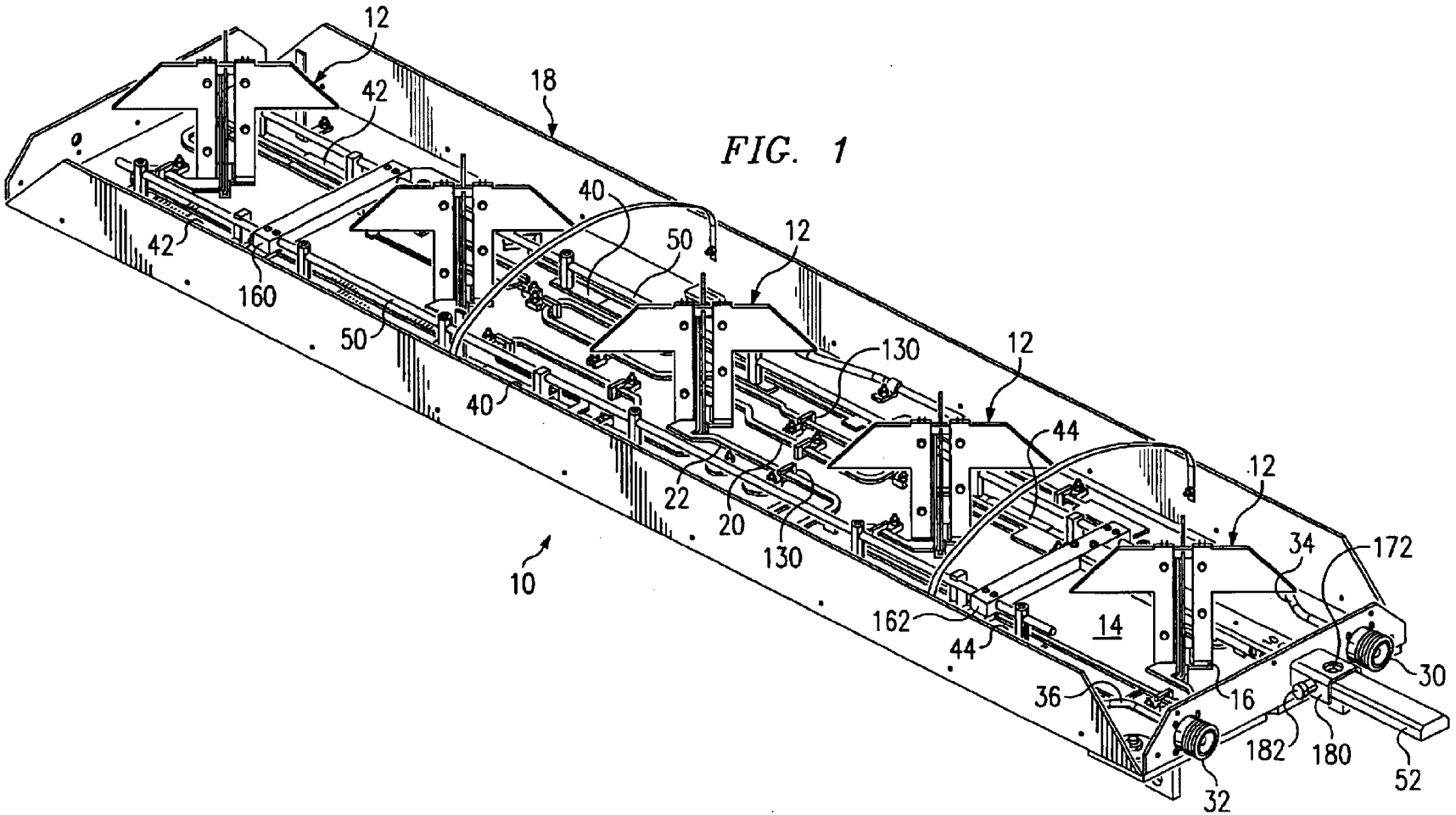
FIG. 1 is a perspective view of a complete antenna sub-assembly having a plurality of vertically polarized unitary dipole antennas, a pair of air dielectric stripline feed systems coupled to each dipole antenna, and sliding dielectric phase shifters providing downtilt.
Figure 2:
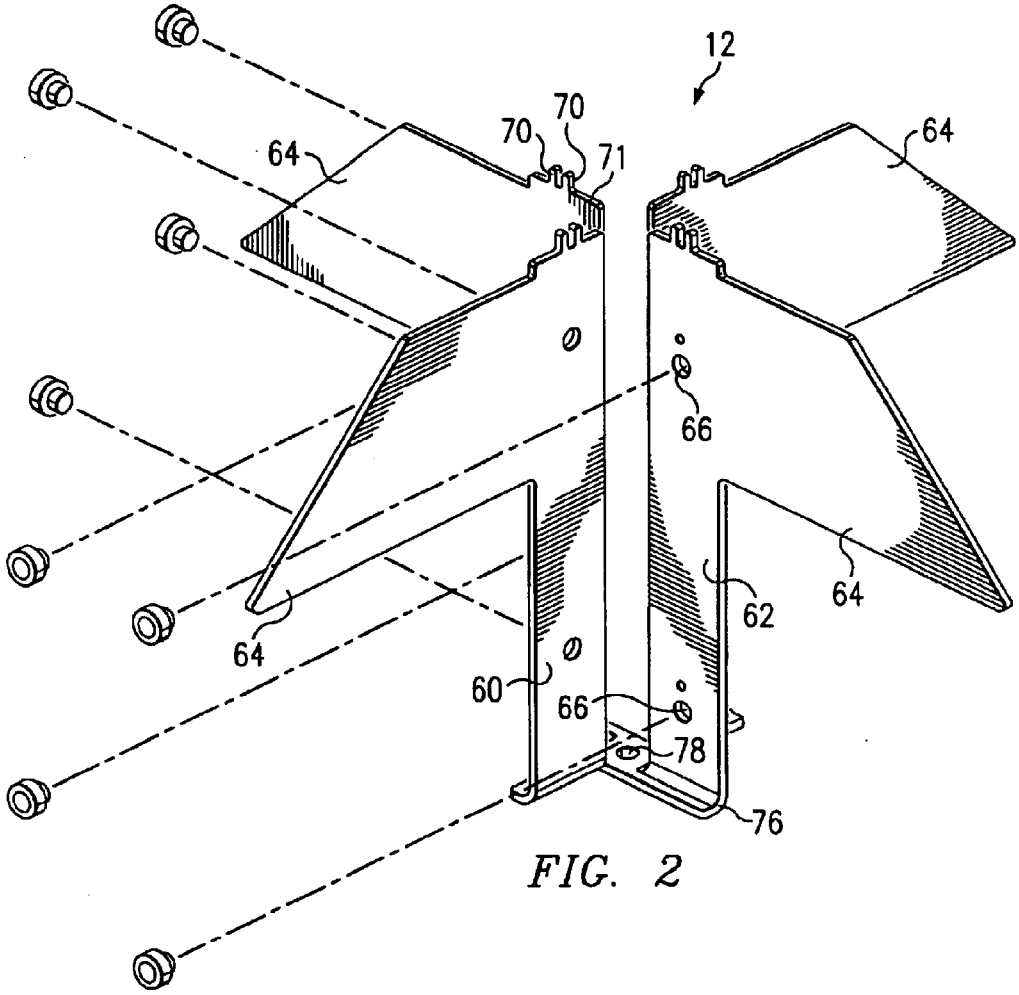
FIG. 2 is a perspective view of one unitary dipole antenna formed from a sheet of stamped metal material.

Referring now to FIG. 1, there is depicted at 10 a perspective view of an antenna array having a plurality of unitary dipole antennas 12 linearly and uniformly spaced from each other upon a groundplane 14. Each unitary dipole antenna 12 is seen to be mounted upon and separated above the groundplane 14 by a respective cross-shaped electrically non-conductive spacer 16. Groundplane 14 comprises the bottom surface of the tray generally shown at 18 and being formed of a stamped sheet of metal, with respective sidewalls being bent vertically as shown. Each unitary antenna 12 is vertically mounted having a cross-liked shape and having a pair of orthogonal radiating elements as shown in FIG. 2. Each of the dipole antennas 12 is coupled to and fed by a pair of air dielectric stripline feed systems, the first being shown at 20 and the second being shown at 22. These air dielectric stripline feed systems 20 and 22 are each uniformly spaced above, and extending parallel to the groundplane 14 to maintain uniform impedance along the stripline between the respective connector 30 and 32 and the antenna 12 as shown. The signal feed from connector 30 includes coax 34 feeding the stripline 20, and coax 36 feeding the stripline 22. Advantageously, each of the stripline feed systems 20 and 22 are formed by stamping a sheet of metal and folding the appropriate antenna coupling portions 90° upward to facilitate coupling to the respective radiating elements of the respective dipole antennas 12.

Also shown in FIG. 1 are two sets of sliding dielectric phase shifters depicted as shifters 40, 42, and 46 slidingly disposed between selected portions of the associated stripline and the groundplane 14. As further illustrated in FIG. 6 and will be discussed more shortly, the phase shifters are actuated by a pair of respective rods 50 coupled to a single downtilt selector rod shown at 52 to perform beamforming and downtilt. These sliding phase shifters will be discussed in more detail shortly.

Figure 9:
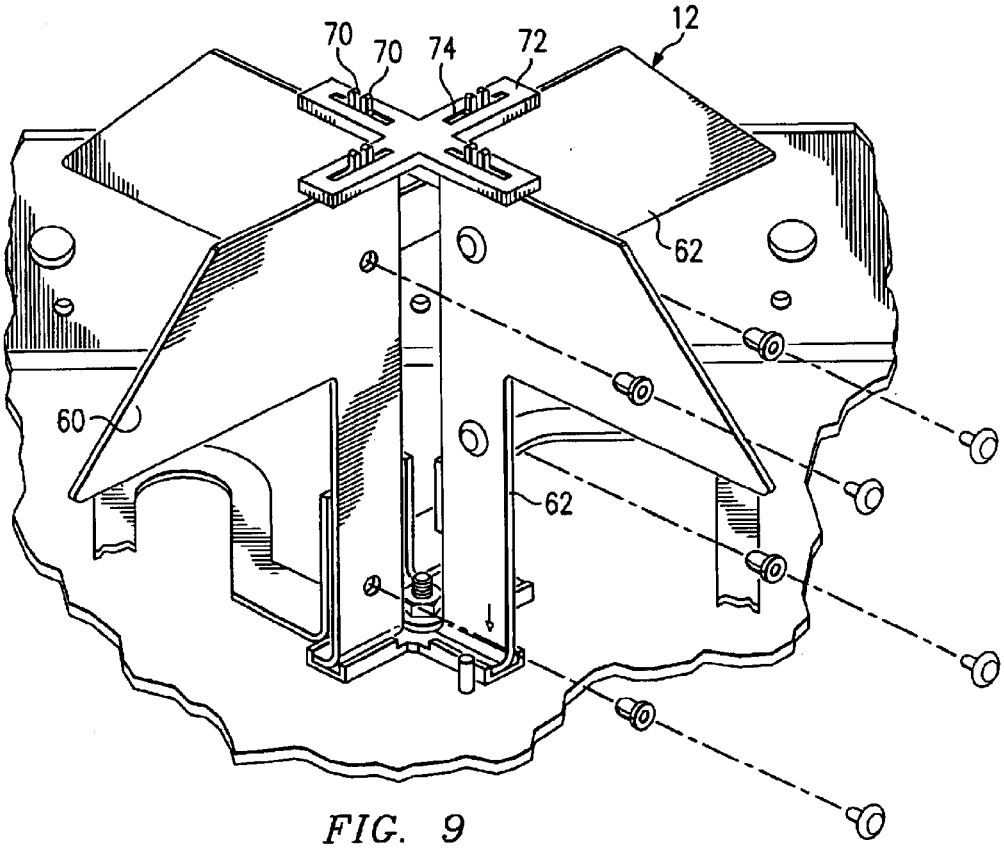
FIG. 9 is a perspective view of one dipole antenna depicting each of the air dielectric stripline feed systems connected to the respective radiating element of the dipole antenna.

Turning now to FIG. 2, there is illustrated one of the unitary dipole antennas 12 seen to be formed from a stamped sheet of metal. The unitary antenna 12 has two orthogonal radiating elements shown at 60 and 62, each extending upwardly and folded roughly 90° as shown. The upper portions of each radiating element 60 and 62 have a laterally projecting, tapered portion generally shown at 64 and a plurality of openings 66 for facilitating the attachment of the respective stripline feed system 20 or 22, as will be discussed shortly. The upper ends of each radiating element 60 and 62 is seen to have a pair of fingers 70 projecting upwardly from a projection 71 and adapted to be received by a non-conductive cross-shaped clip 72 as shown in FIG. 9. This cross-shaped clip 72 has a respective opening 74 defined through each arm thereof to securingly receive the respective projecting portions 71 of the radiating element 60 and 62, with the fingers being folded in opposite directions to secure the clip thereunder. Advantageously, this non-conductive clip 72 maintains the cross shape of the dipole 12 such that each extension 64 is orthogonal to the other. The base portion of antenna 12 is shown at 76 and is seen to have a central opening 78 for receiving securing hardware therethrough as shown in FIG. 1 such as a screw and bolt.

Figure 3:
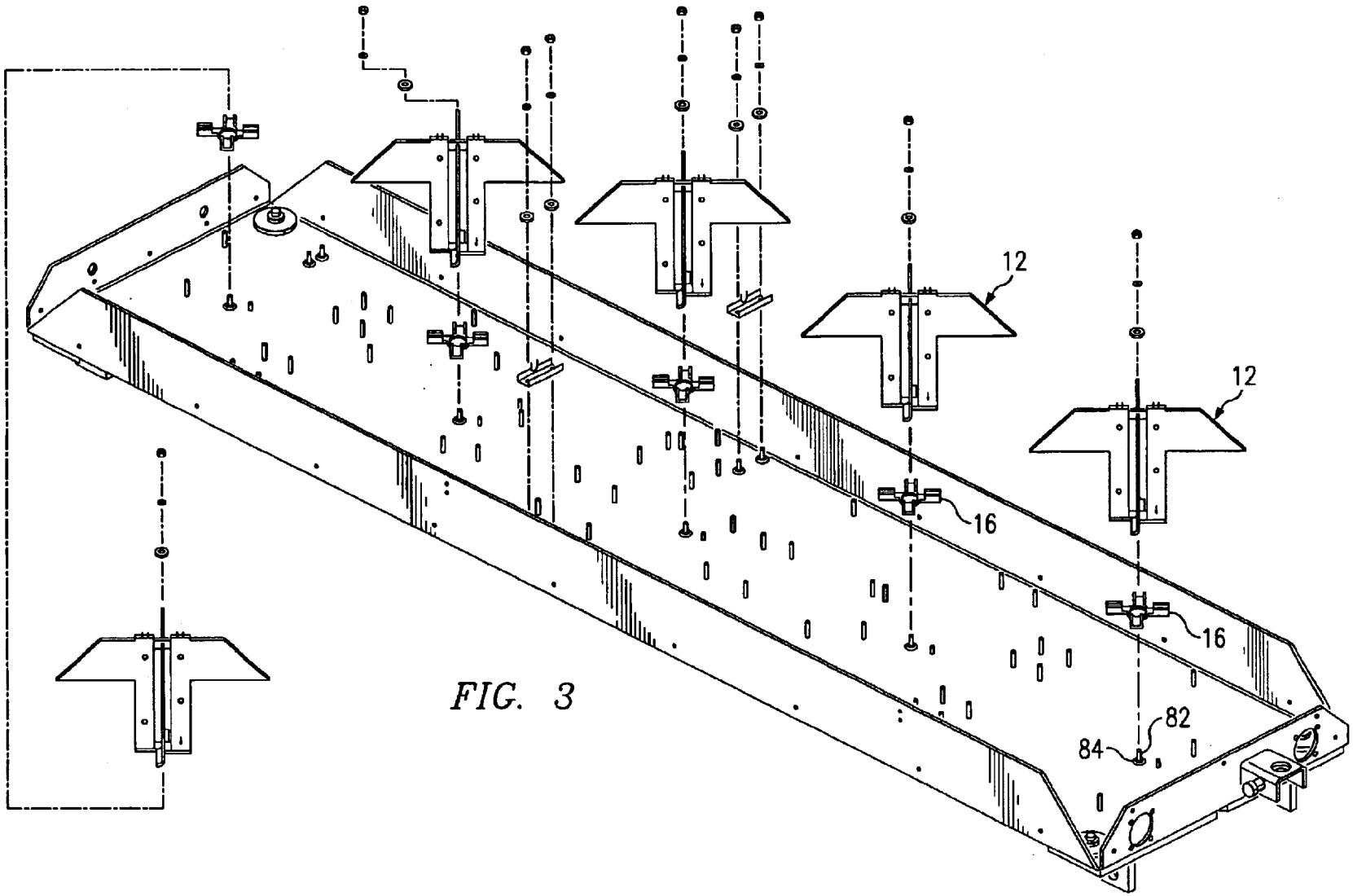
FIG. 3 is an exploded view of the antenna assembly depicting the dipole antennas, the electrically non-conductive spacers separating the antennas above the groundplane, and associated fastening hardware.

Turning now to FIG. 3, there is illustrated an exploded view of the antenna 10 illustrating, in this embodiment, the five separate dipole antennas 12 adapted to, be coupled to and spaced above the groundplane 14 by the corresponding conforming non-conductive spacer members 16. Each of the spacer members 16 is seen to be secured about a corresponding extending threaded stud 82 and secured upon extending an elevated dimple shown at 84 shown to protrude upwardly from the groundplane 14 as shown. The elevated dimple 84 is adapted to allow adequate compression of the attaching hardware to secure the respective antenna 12 upon the groundplane 14.

Figure 4:
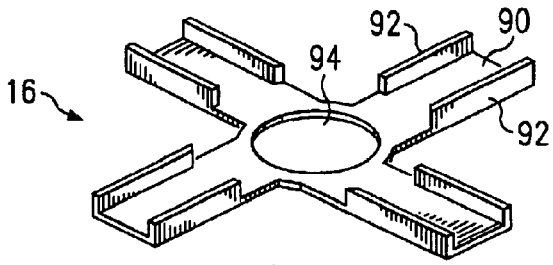
FIG. 4 is a perspective view of the non-conductive spacer used for spacing the respective antenna above the groundplane and preventing moisture accumulation thereof.

Turning now to FIG. 4, there is illustrated a perspective view of the non-conductive base member 16, whereby each arm shown at 90 has a pair of opposing sidewalls 92. Each member 16 has a central opening 94 adapted to receive a corresponding threaded stud 82 shown in FIG. 3. Advantageously, the sidewalls 92 are spaced from the respective sidewalls of the next arm 90 to alleviate the possibility that any moisture, such as from condensation, may pool up at the intersection of the respective arms 90 and cause a shorting condition between the respective antenna 12 and the groundplane 14.

Figure 5:
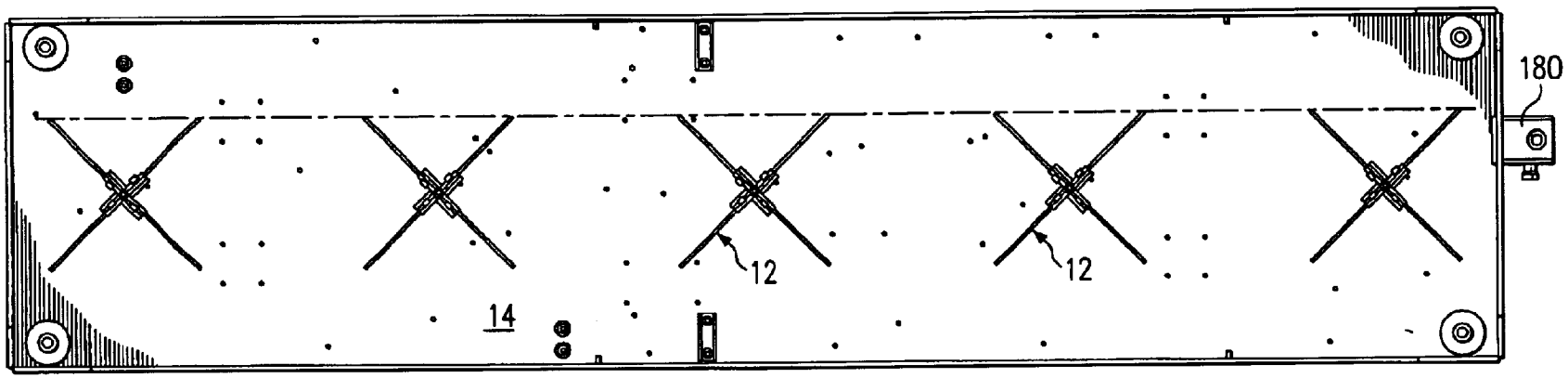
FIG. 5 is a top view of the antenna assembly illustrating the orthogonal relationship of the dipole radiating element.

Turning now to FIG. 5, there is illustrated a top view of the antenna sub-assembly illustrating the cross-shaped dipole antennas 12 with the associated cross-shaped member 72 removed therefrom, illustrating the attaching hardware secured through the base of the respective antennas 12 and the base members 16 to the projecting studs 82. As depicted, the radiating elements of antenna 12 are orthogonal to each other. Also depicted is the portions of each of the radiating elements 60 of each antenna 12 being parallel to each other and thus adapted to radiate in the same direction. This arrangement facilitates beamforming as will be discussed more shortly. Likewise, each of the portions of radiating elements 62 of each antenna 12 are also parallel to each other and thus also radiate energy in the same direction.

Figure 6:
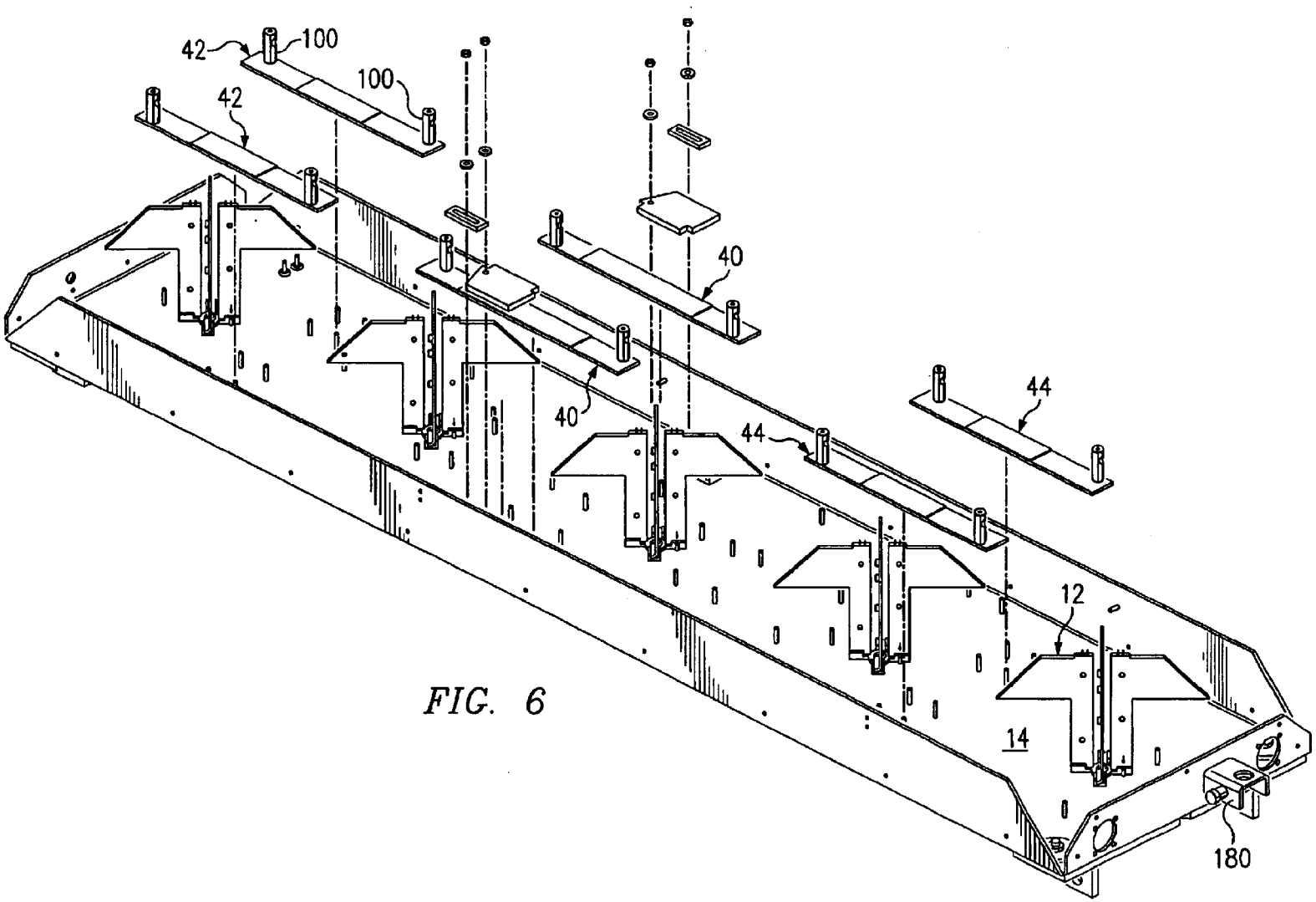
FIG. 6 is an exploded perspective view of the sliding dielectric phase shifters each having a plurality of dielectric members for providing downtilt.

Turning now to FIG. 6, there is shown the sliding dielectric phase shifters depicted as shifters 40, 42, and 44. Each of these phase shifters is seen to have a central section having a first dielectric constant, and a pair of opposing adjacent dielectric sections extending laterally therefrom having a second dielectric constant, as will be discussed in more detail shortly. Each phase shifter is seen to have an opposing rod guide post 100 with an opening 102 extending therethrough. The openings 102 of each post are seen to be axially aligned to receive the respective rod 50 as shown in FIG. 1. The phase shifters are slidingly disposed upon the groundplane 14 and slidable along with the associated rod to affect phase shift of signals transmitted through the proximate stripline thereabove.

Figure 7:
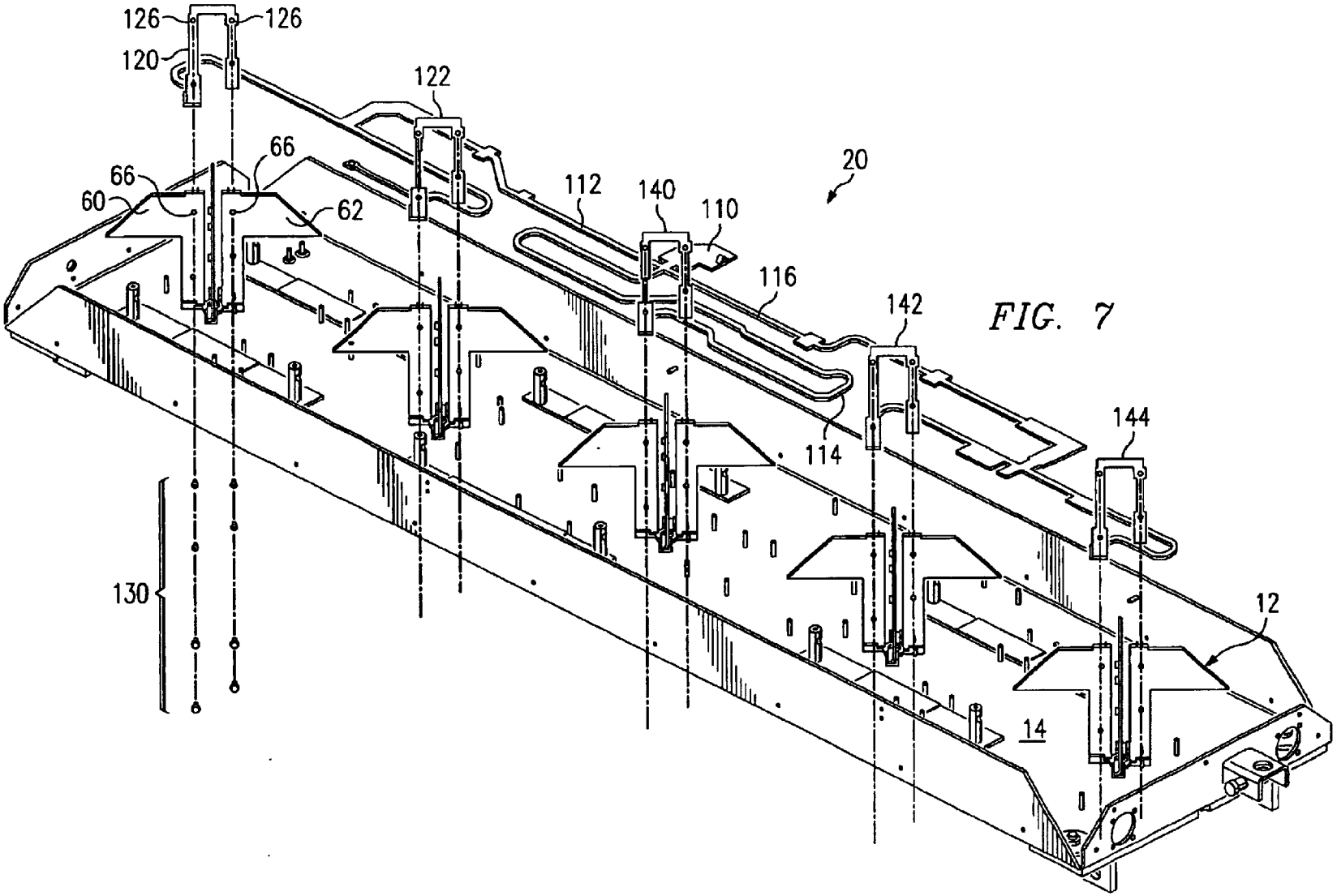
FIG. 7 is an exploded perspective view of a first air dielectric stripline feed system coupled to and feeding the first radiating element of each dipole antenna and having portions positioned over the phase shifters.

Referring now to FIG. 7, there is shown an exploded view of the first air-dielectric stripline feed system 20, formed by stamping a sheet of sheet metal. Stripline feed system 20 is seen to have a central connection pad 110 feeding a first stripline 112, a central stripline 114, and a third stripline 116 as shown. Each of these striplines has a commensurate width and thickness associated with the frequencies to be communicated to the respective dipole antennas 12. The first stripline 112 is seen to split and feed a first pair of vertical coupling arms 120 and 122. Each of these coupling arms 120 and 122 are formed by bending the associated distal stripline portion 90° such that they are vertically oriented, corresponding and parallel to the vertically oriented radiating elements 60 and 62 of the corresponding antenna 12. Each member 120 and 122 is seen to have corresponding openings 126, each opening 126 corresponding to one of the openings 66 formed through the radiating elements 60 and 62, as shown in FIG. 2. In this embodiment, an RF signal coupled to stripline assembly 20 at pad 110 will be communicated and coupled to the portions of radiating elements 60 and 62 which are co-planar with one another as shown.

Figure 12:
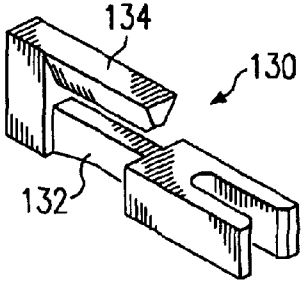
FIG. 12 is a perspective view of the air strip stand-off depicted in FIG. 10 to maintaining uniform air spacing between the stripline feed system and the groundplane of the tray.

The stripline feed system is spaced upon the groundplane 14 by a plurality of electrically non-conductive spacers 130 as shown in FIG. 12. Each of these spacers 130 is contoured at neck 132 to prevent moisture from accumulating proximate to the supported stripline, and has an upper projecting arm 134 frinctionally securing the stripline therebetween. Spacer 130 is formed of an electively non-conductive material, such as Delrin. The present invention achieves technical advantages by maintaining a uniform air dielectric between the stripline feed system 20 and the groundplane 14 thereby minimizing intermodulation (IM) which is an important parameter in these types of antennas.

Still referring to FIG. 7, there is illustrated that center stripline 114 also terminates to a respective coupling arm shown at 140. Likewise, third stripline 116 is seen to split and feed a respective pair of coupling arms 142 and 144 similar to coupling arms 120 and 122 just discussed. Notably, the lengths of striplines 112, 114 and 116 have the same length to maintain phase alignment.

Figure 8:
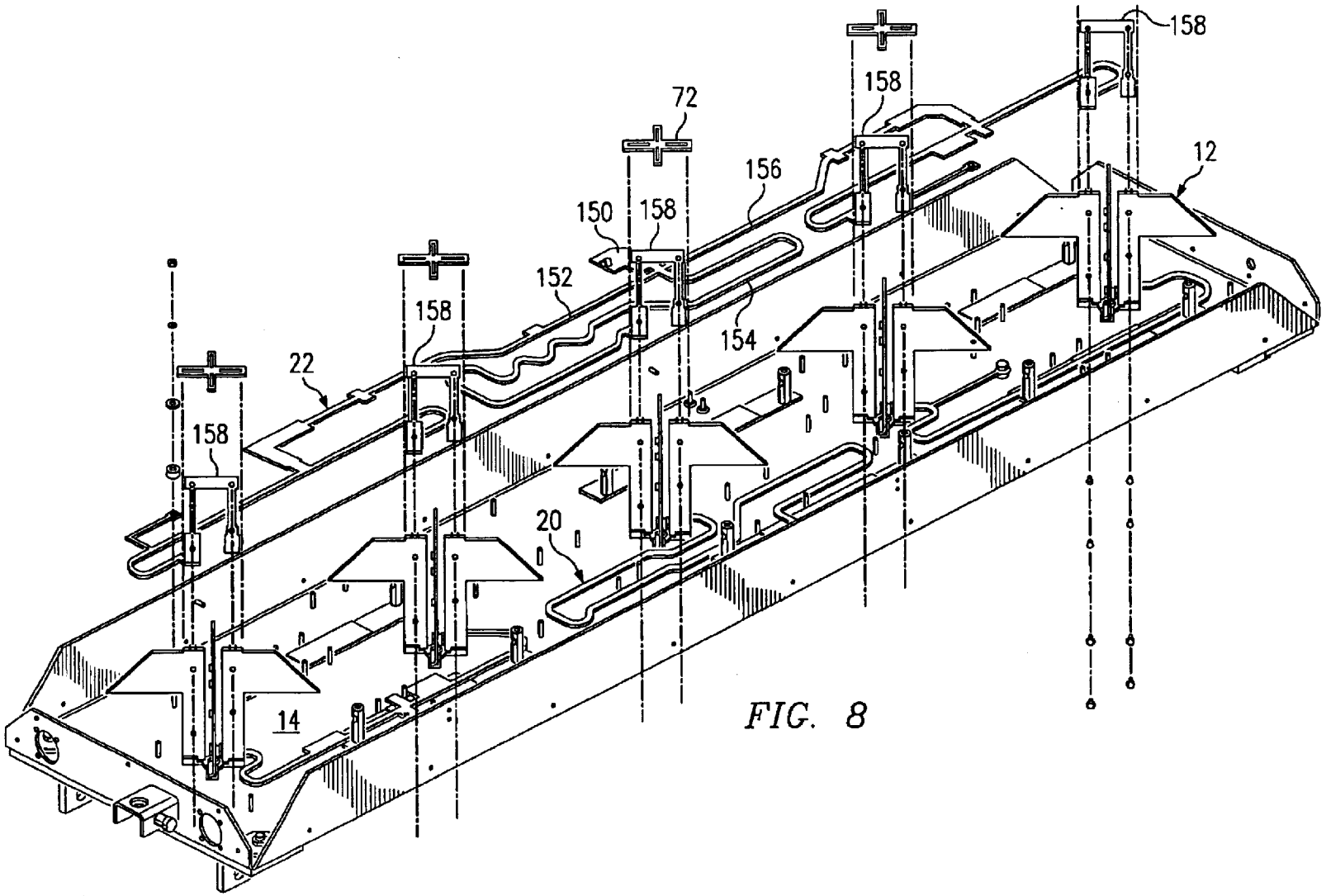
FIG. 8 is an exploded perspective view of the second air dielectric stripline feed system also formed from a stamped sheet of metal coupled to and feeding the second radiating element of each dipole antenna and positioned over respective phase shifters.

Turning now to FIG. 8, there is illustrated the second air dielectric stripline feed system 22 configured in a like manner to that of the first stripline feed system 20, and adapted to couple electrical signals to the arms of the antennas 12 that are orthogonal to those fed by the corresponding stripline feed system 20. Stripline feed system 22 is seen to have a central connection pad 150 feeding three striplines 152, 154 and 156, each having the same length as the other and feeding the respective vertically oriented coupling members shown at 158. Like stripline feed system 20, stripline feed system 22 is uniformly spaced above the groundplane 14 by an air dielectric, which is the least lossy dielectric supported thereabove by a plurality of clips 130 shown in FIG. 12. Each of the coupling members 158 extend vertically 90° from the co-planar stripline feed lines and are electrically coupled to the respective arms of antenna 12 by hardware.

Figure 10:
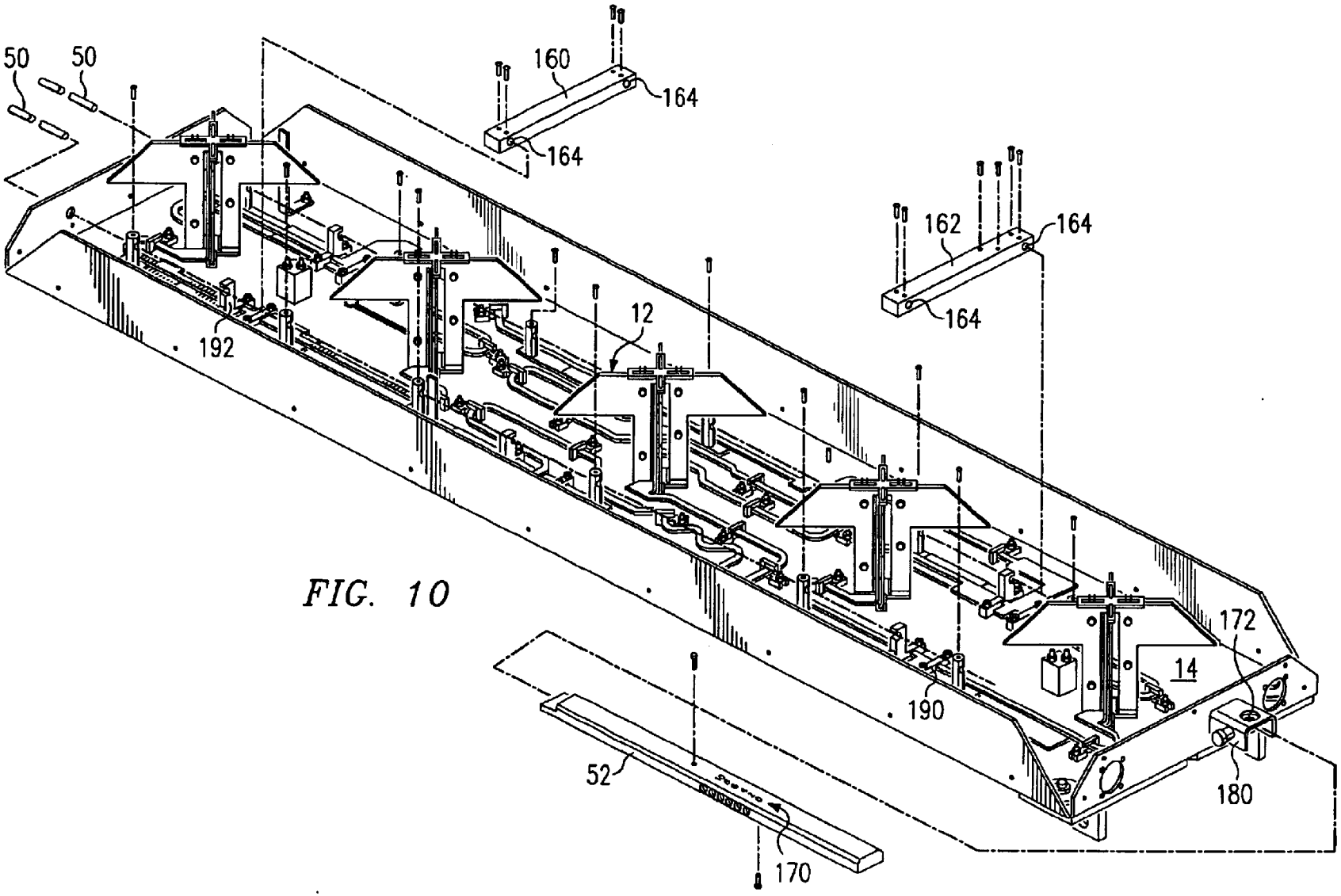
FIG. 10 is an exploded perspective view of the antenna sub-assembly including the rod guides coupled to the associated phase shifter.

Referring now to FIG. 10, there is illustrated a pair of rod guide bars 160 162 secured to the groundplane 14 and each having a pair of opposing openings 164 for slidingly receiving the corresponding slide rod 50. Each of the openings 164 are axially aligned with the corresponding other opening such that each of the slide rods 50 can axially slide therethrough when correspondingly activated by adjustment member 52. Adjustment member 52 is seen to have indicia shown at 170 that indicates the downtilt of the antenna when viewed through an indicator opening or window shown at 172. Thus, if the numeral "6" is visible through the opening 172, the antenna array 10 is aligned to beam steer the radiation pattern 6° blow horizontal. This allows a technician in the field to select and ascertain the downtilt of the beam pattern quickly and easily. When installed, the antenna array 10 is typically vertically oriented such that the selection member 52 extends downwardly towards the ground.

Figure 11:
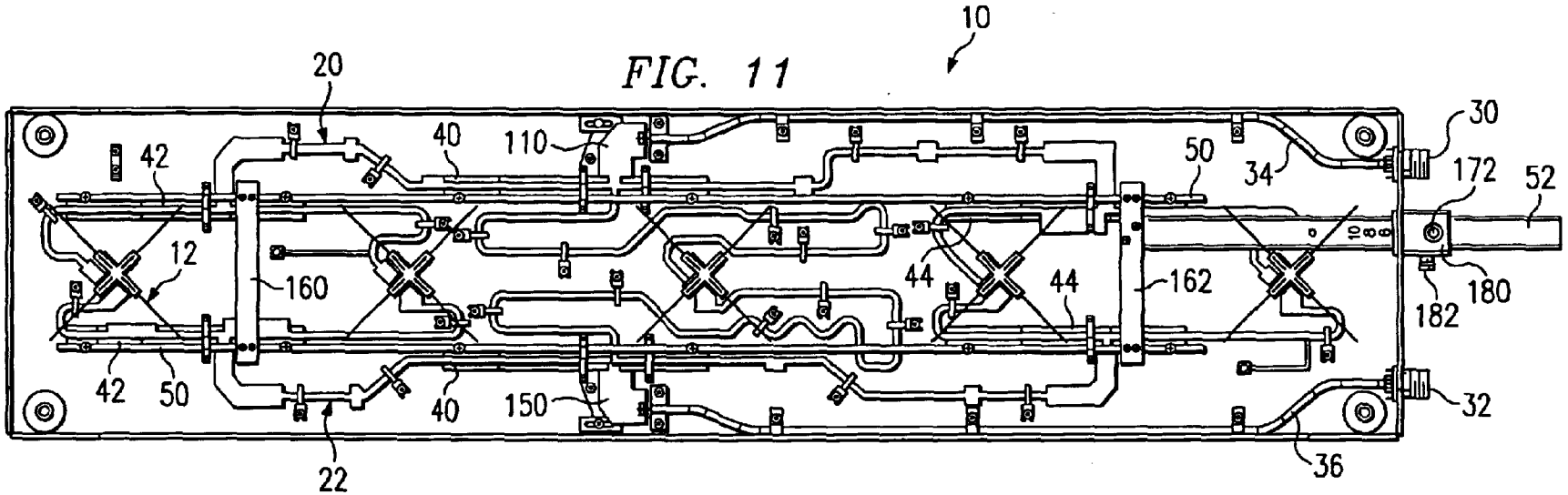
FIG. 11 is a top view depicting the cable bends coupling the pair of connectors to the air dielectric stripline feed systems.

Turning now to FIG. 11, there is shown a top view of the antenna sub-assembly including the dipole antennas, the air dielectric stripline feed systems 20 and 22, the corresponding phase shifters 40, 42, and 44, slide rods 50, the slide bar bridges 160 and 162 and the selector member 52 secured to the bridge 162 as shown. A selector guide member 180 is seen to include the opening 172 and a set screw 182 laterally extending therethrough to selectively secure the position of adjustment member 52 with respect to the guide 180 once properly positioned. The downtilt of the antenna 10 is adjusted by mechanically sliding adjustment member 52, thus correspondingly adjusting the dielectric phase shifters 40, 42, and 44 with respect to the corresponding feedlines disposed thereabove and the groundplane 14 therebelow. Coax lines 34 and 36 are seen to have respective center conductor curled and soldered to the respective feed pad 110 and 150.

Figure 14:
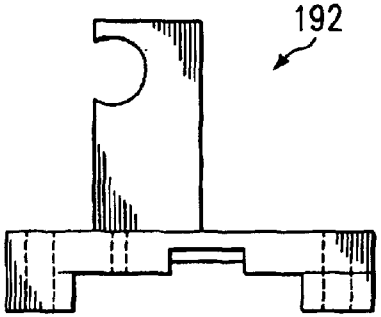
FIG. 14 is an illustration of the second shifter bridge.
Figure 13:
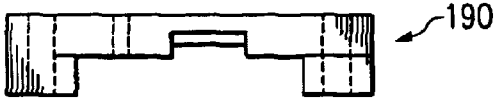
FIG. 13 is an illustration of the shifter bridge.

FIG. 13 illustrates a shifter bridge 190, and FIG. 14 illustrates a shifter bridge 192 as depicted in FIG. 1.

Referring now back to FIG. 1, there is depicted that the associated stripline feed systems 20 and 22 are separated above the groundplane 14 by the respective phase shifter assemblies 40, 42 an 44 at the dividing portions of the striplines. Advantageously, the dielectric of these phase shifters is not uniform along the length thereof, thus advantageously providing the capability to adjust the phase of the signal coupled by the stripline by the corresponding phase shifter. As shown, each of the three phase shifters 40, 42, and 44 associated with each respective stripline feed system 20 and 22 are correspondingly adjusted in unison with the other by the associated slide rod 50. Thus, for instance, by sliding adjustment member 52 in the lateral direction 0.2 inches, and thus the corresponding rods 50, such that the indicia 174 viewable through window 172 changes from "0" to "2", each of the phase shifters 40, 42, and 44 will each be laterally slid below the dividing portion of the associate stripline the corresponding 0.2 inches. Likewise, shifting member 52 1.0 inches will effect a 10° downtilt.

As will now be described, since each of the phase shifters 40, 42, and 44 are comprised of different dielectric segments, that is, segments that have different lengths and dielectric constants, the signals conducted through the striplines proximate the phase shifters can be tuned and delayed such that the overall beam generated by antennas 10 can be shifted from 0 to 10 degrees with respect to the groundplane 14. The indicia 174 is calibrated to the phase shifters when viewed through opening 172.

Figure 15:
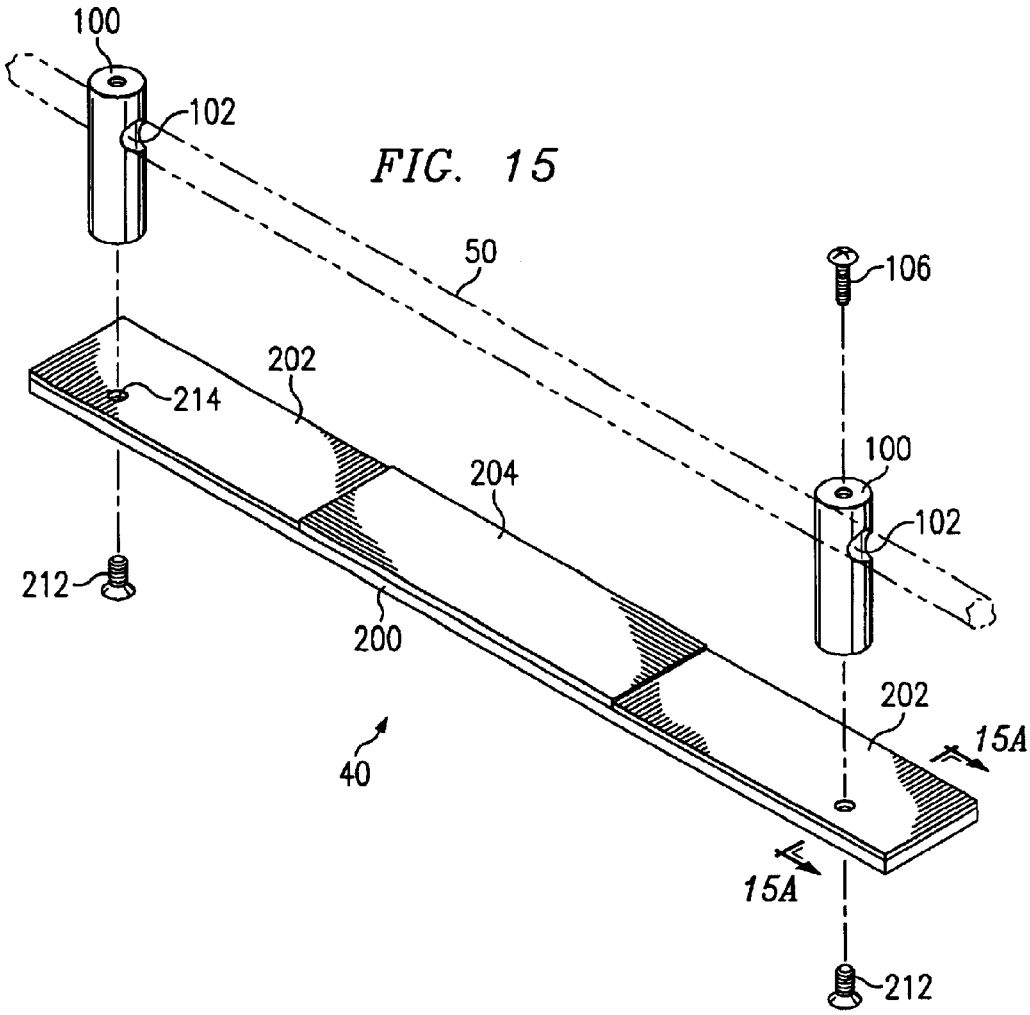
FIG. 15 is a perspective view of the first phase shifter sub-assembly depicting the shifter rod being connected to the dielectric phase shifter by a set screw.
Figure 17:
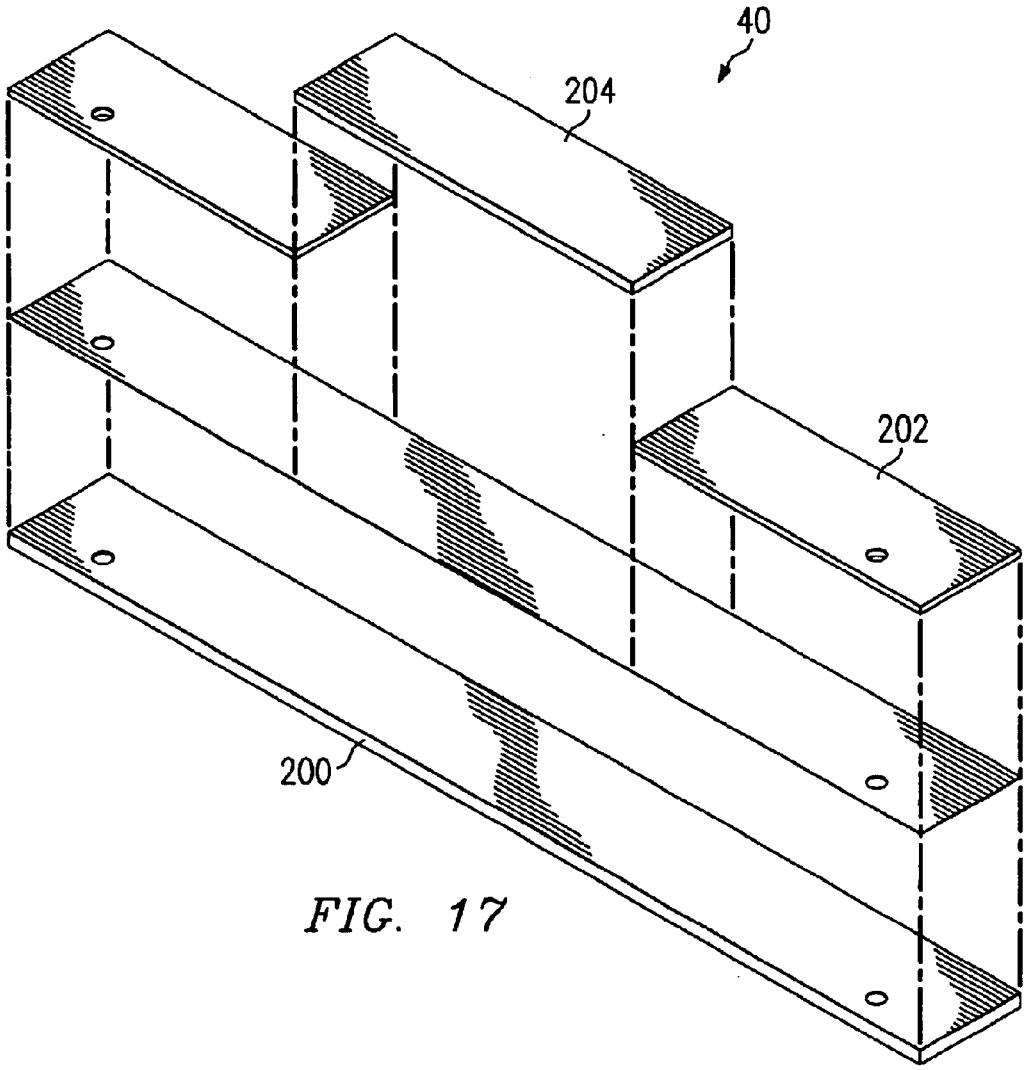
FIG. 17 is an exploded perspective view of the different dielectric members of the first shifter body sub-assembly utilized to phase shift a signal of the stripline feed assembly.

Turning now to FIG. 15, there is illustrated the first phase shifter in more detail. The first phase shifter 40 is seen to comprise a composite of dielectric materials as further illustrated in FIG. 17. The phase shifter 40 is seen to include a base member 200 being uniformly rectangular and having a first dielectric constraint, such as a dielectric constraint of $\bullet_r$=2.1.

Secured upon the first dielectric member 200 is seen to be a pair of opposing second dielectric members 202 and a third dielectric member 204 disposed therebetween. The dielectric constant of second dielectric members may be $\bullet_r$=2.1 with a dielectric constant of the third member 204 having the dielectric of •$_r$=3.38. The relative dimensions of these dielectric members, in combination with the dielectric constants of these members, establishes and controls the phase shift of the signal through the stripline disposed thereabove. By way of example, the phase shifter 40 depicted in FIG. 1, has an overall dimension of 1.00 inches by 8.7 inches, with the central dielectric member 204 having a dimension of 1.00 inches by 3.30 inches, and the end dielectric members 202 each having a dimension of 1.00 inches by 2.70 inches.

Figure 15A:
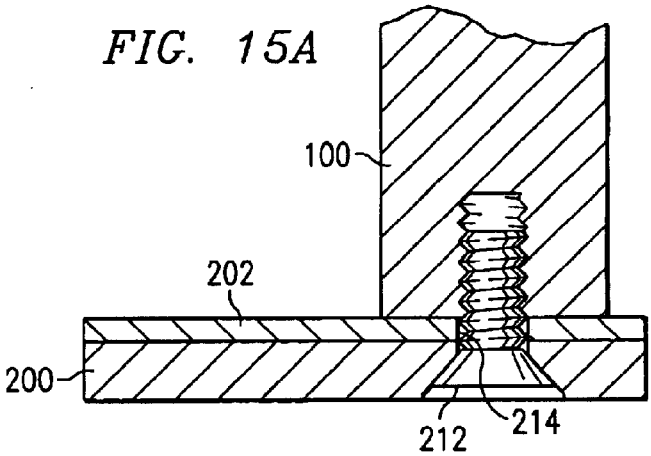

As shown in FIG. 15, the stand-off 100 is secured to each end of the assembly 40 by a fastener 212 extending through a corresponding opening 214 in the assembly 40 and received within the base of the respective stand-off 100. Each of the stand-offs 100 has a through opening 102 having a diameter corresponding to the slide rod 50. The slide rod 50 is secured to each of the stand-offs 100 by a set screw 106 such that any axial shifting of the guide bar 50 correspondingly slides the corresponding phase shifter 40 therewith. FIG. 15A depicts a cross-sectional view taken along the line 15—15 in FIG. 15.

Figure 16:
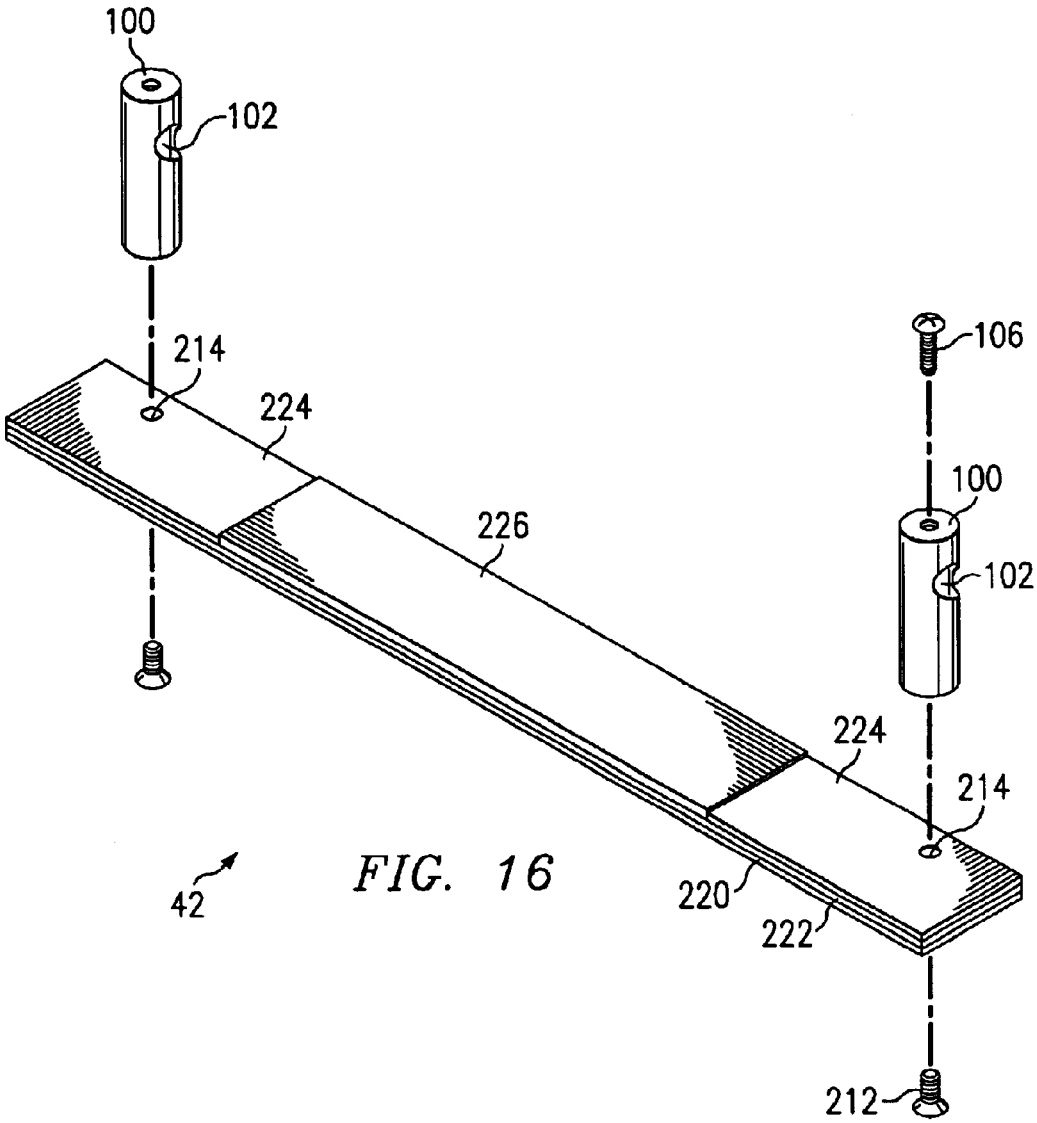
FIG. 16 is a perspective view of the second and third phase shifter sub-assembly.

Turning now to FIG. 16, there is depicted one of the phase shifters 42, which is similar to the phase shifter 44, but for purposes of brevity only phase shifter 42 will be described in considerable detail. Phase shifter 42 is seen to be similar to phase shifter 40 but has different dimensions and materials of different dielectric constants as will now be described. Phase shifter 42 is seen to include a first dielectric base member 220 having, for instance, dimensions of 1.00 inches by 9.70 inches. This base member preferably has a dielectric of •$_r$=10.2. Disposed upon the first dielectric member 220 is a middle dielectric member 222 having the same dielectric dimensions as the first dielectric member 220. The upper dielectric members comprise of a dielectric member 224 at opposing ends thereof, with a middle dielectric member 226 disposed therebetweeen and adjacent the others as shown. The dielectric constant of the dielectric members 224 may be, for instance, •$_r$=2.1, with the middle dielectric member 226 having a dielectric of •$_r$=3.38. The dimensions of these top dielectric members, however, may be 1.00 inches by 2.10 inches for the dielectric members 224, and a dimension of 1.00 inches by 5.50 inches for the middle dielectric member 226 having a dielectric of •$_r$=10.2. As shown, each of the phase shifters 42 also have a pair of respective stand-offs 100 having openings 102 adapted to securingly receive the respective guide bar 50 as shown.

Figure 18:
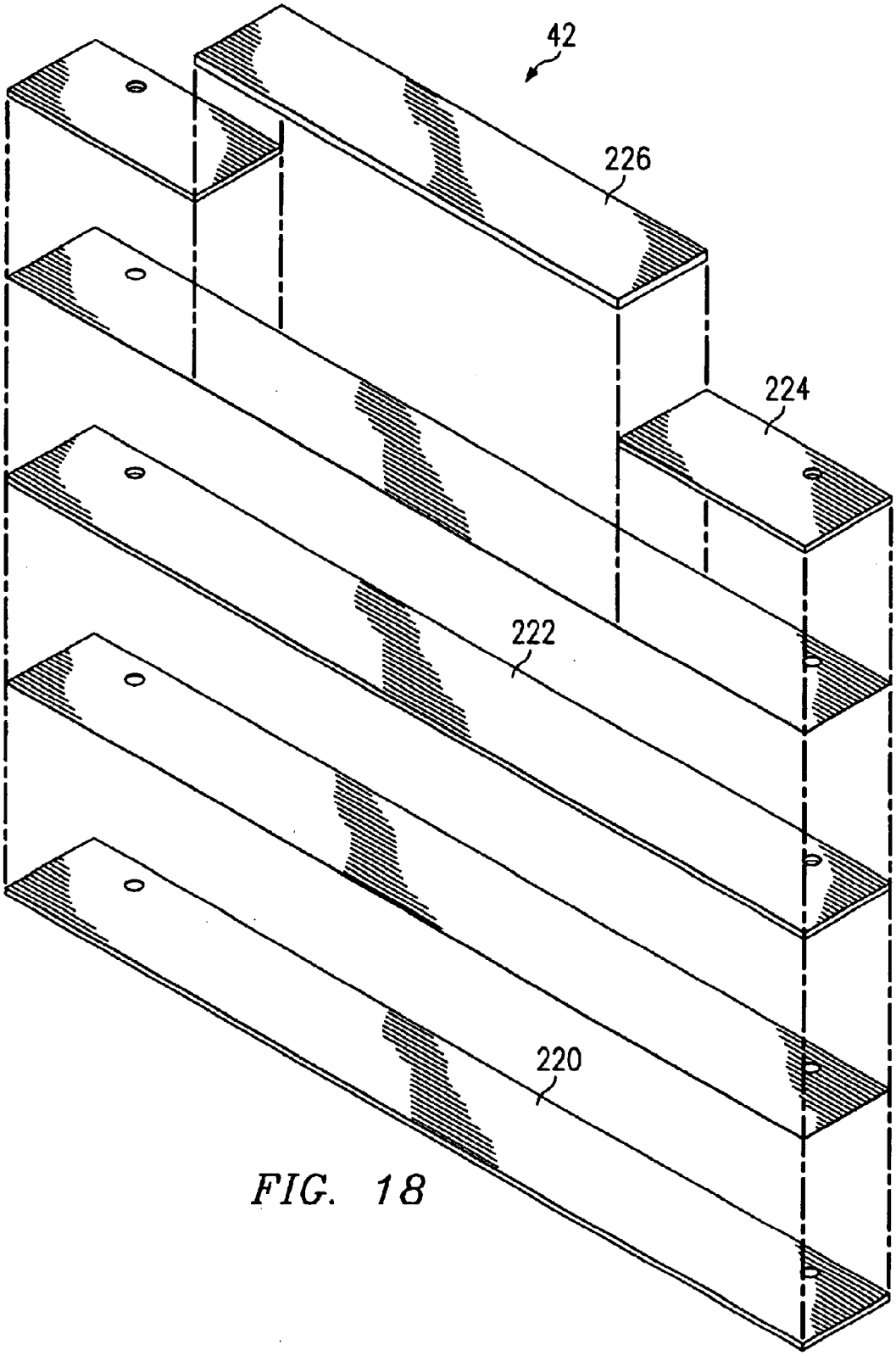
FIG. 18 is an exploded perspective view of the different dielectric members of the second and third shifter body sub-assembly utilized at each end of the stripline feed system and having appropriate dielectric materials.

FIG. 18 depicts an exploded view of the phase shifter dielectric members; forming phase shifter 42. Disposed therebetween there is seen to be a layer of adhesive for securing the dielectric members in place with respect to each other, as shown.

Figure 19:
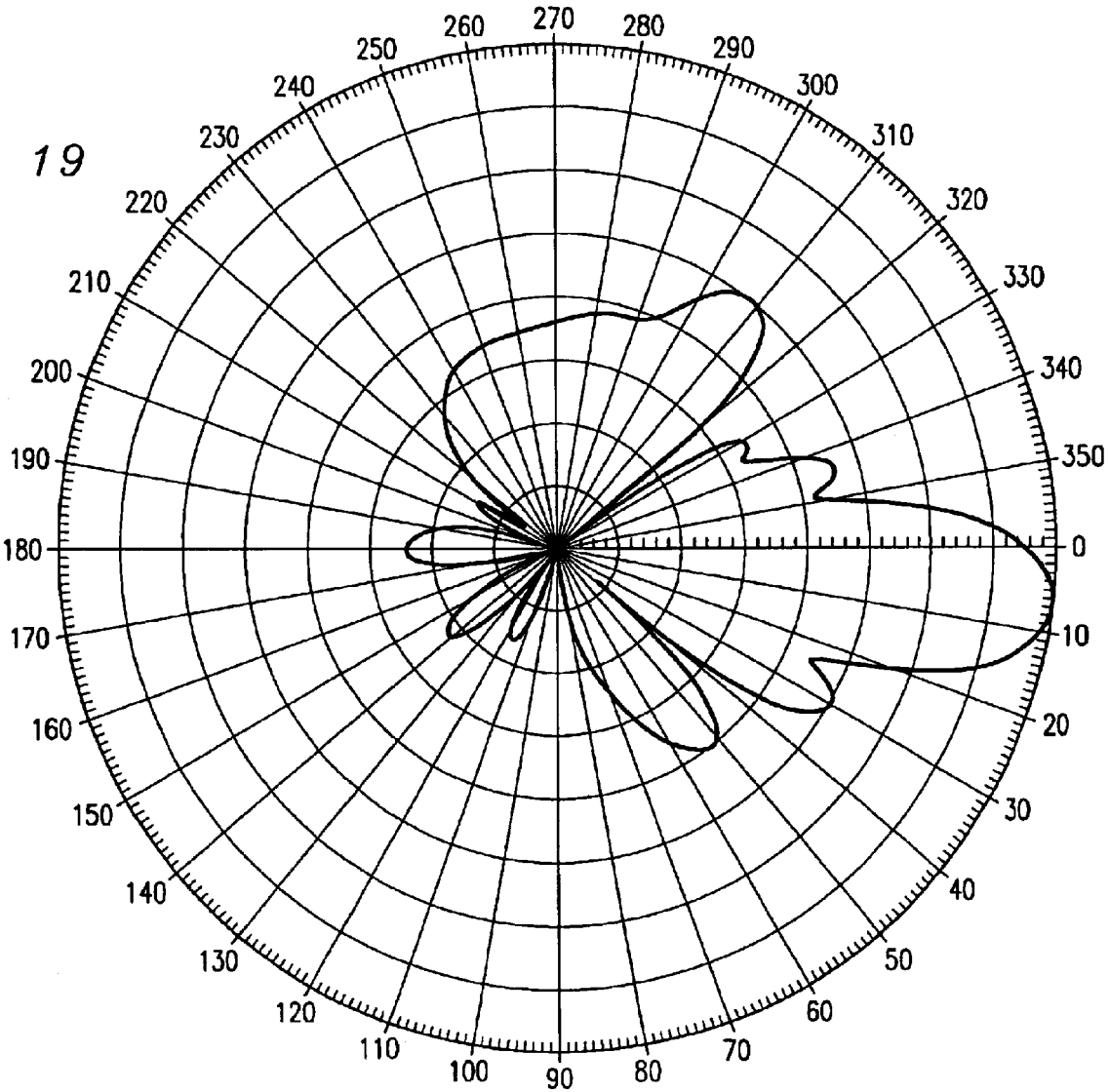
FIG. 19 is a graph illustrating the available 10° downshift of the antenna assembly while maintaining uniform side lobes.

Referring now back to FIG. 11, it can be further understood that as the selector member 52 is axially adjusted through member 182, both of the corresponding sliding rods 50 are slid therewith, thus sliding the associated phase shifter assemblies 40, 42 and 44 between the groundplane 14 and the respective stripline of the feed systems 20 and 22. The displacement of the various dielectric members of each of the phase shifter assemblies, in combination with the layout of the stripline segments extending over the respective dielectric members, together causes a phase shift of the signal travelling through the stripline above the phase shifter assemblies. The orchestration of the shifting phase shifter assemblies, along with the geometries and dielectric constants of the dielectric materials, causes the beam generated by the antenna 10 to vary between 0 and 10 degrees below horizontal, providing a downshift when the antenna 10 is vertically oriented with the shifter rod 52 extending downwardly. As shown in FIG. 1, each of the sliding rods 50 are simultaneously correspondingly slid with selector rod 52 to slidingly adjust the respective sets of phase shift assemblies, 40, 42, and 44 controlling the phase of the signals provided to the respective dipoles of the antennas 10. That is, each of the phase shifter assemblies 40 corresponding to each of the stripline feed systems 20 and 22 shift in unison with one another, and, have the same effect on phase of the corresponding signals routed through the associated feed systems. Thus, the phase shift in each of the signals communicated to each of dipole of antenna 12 is adjusted in unison to achieve an intended uniform downshift of the radiation pattern, and advantageously, such that the associated side lobes remain uniform and constant as-depicted graphically in FIG. 19. Advantageously as the main lobe of the radiation pattern is adjusted from 0 to 10 degrees, while the side lobes remain uniform and balanced as shown.

Although a preferred embodiment of the method and system of the present invention has been illustrated in the accompanied drawings and described in the foregoing Detailed Description, it is understood that the invention is not limited to the embodiments disclosed, but is capable of numerous rearrangements, modifications, and substitutions without departing from the spirit of the invention as set forth and defined by the following claims.

What is claimed is:

1. An antenna assembly, comprising:

a ground plane;

a first antenna comprising a first vertically extending radiating element coupled to said ground plane via a dielectric material; and a first air dielectric stripline feed member coupled to said first radiating element and spaced from said ground plane by an air dielectric.

2. The antenna assembly as specified in claim 1 wherein said first feed member has a portion extending parallel to said ground plane and being spaced thereabove by an electrically non-conductive member.

3. The antenna assembly of claim 2 wherein said first feed member is a unitary member.

4. The antenna assembly of claim 3 wherein said first unitary member is stamped from an electrically conductive sheet of material.

5. The antenna assembly of claim 4 wherein paid first unitary feed member is bent proximate and coupled to said radiating element.

6. The antenna assembly of claim 1 wherein paid first antenna further comprises a second vertically extending radiating element and comprising a dipole, wherein said first feed member is coupled to both said first and second radiating element.

7. The antenna assembly of claim 6 further comprising a second air dielectric stripline feed member coupled to both said first and second radiating element.

8. The antenna assembly of claim 6 wherein said first and second radiating elements are orthogonal to each other.

9. The antenna assembly of claim 7 wherein said first and second feed members each have a connection portion coupled to said first and second radiating elements, wherein said connection portions are orthogonal to each other.

10. The antenna assembly of claim 3 wherein said radiating element is a unitary member.

11. The antenna assembly of claim 6 wherein said dipole antenna is a unitary member.

12. The antenna assembly of claim 6 wherein both said dipole antenna and said first and second feed members are formed of a bent sheet of electrically conductive material.

13. The antenna assembly of claim 12 wherein both said dipole antenna and said feed members stamped and folded members.

14. The antenna assembly of claim 6 wherein said dipole antenna has a "cross" shape.

15. The antenna assembly of claim 14 wherein both said first and said second radiating elements have a "L" shape in the vertical direction.

16. The antenna assembly of claim 14 further comprising an electronically non-conductive member being secured to said cross-shaped dipole antenna maintaining an orthogonal relationship between the first and second radiating elements.

17. The antenna assembly of claim 1 further comprising a second antenna being spaced from said first antenna, wherein said first feed member is coupled to both said first and second antennas.

18. The antenna assembly of claim 14 further comprising a second cross shaped dipole antenna spaced from said first dipole antenna and a second air dielectric stripline feed member, said first feed member being coupled to portions of said first and second cross shaped dipole antennas adapted to radiate in a first direction, and said second feed member being coupled to portions of said first and second dipole antennas adapted to radiate in a second direction.

19. The antenna assembly of claim 1 wherein said first feed member has a portion coupled to said first antenna that is parallel to the first antenna.

20. The antenna assembly of claim 6 wherein said first and second vertically extending radiating elements are spaced from one another.

* * * * *